US005282756A

United States Patent [19]

Heindl et al.

[11] Patent Number: 5,282,756

[45] Date of Patent: Feb. 1, 1994

[54] ELECTRICAL LAMP BASE AND SOCKET ASSEMBLY

[75] Inventors: Raymond A. Heindl, Euclid; Lawrence T. Mazza, Mayfield Heights, both of Ohio

[73] Assignee: General Electric Company, Schenectady, N.Y.

[21] Appl. No.: 989,430

[22] Filed: Dec. 11, 1992

[51] Int. Cl.[5] ..... H01R 4/50

[52] U.S. Cl. ..... 439/336; 439/675; 439/356

[58] Field of Search ..... 439/335, 336, 346, 356, 439/615, 616, 672, 673, 675

[56] References Cited

U.S. PATENT DOCUMENTS 4,165,144 8/1979 Cooke et al. ..... 439/336
4,572,601 2/1986 Jones et al. ..... 439/336 X
5,154,628 10/1992 Skegin ..... 439/336
5,154,645 10/1992 Harada et al. ..... 439/336 X

*Primary Examiner*—Larry I. Schwartz
*Assistant Examiner*—Khiem Nguyen
*Attorney, Agent, or Firm*—George E. Hawranko; Stanley C. Corwin

[57] ABSTRACT

The invention relates to an electrical lamp base and socket assembly for mechanically holding and supplying power to an electrical lamp, having a vitreous envelope, allowing mainly axial motion for the lamp and avoiding any turning motion over a certain angle during its insertion into and removal from the socket. The lamp base and socket are made of insulating material, and the lamp base has slot on its surface while the socket has mechanical means with spring mechanism and protruding parts engaging the slot of the socket.

9 Claims, 4 Drawing Sheets

ELECTRICAL LAMP BASE AND SOCKET ASSEMBLY

CROSS-REFERENCE TO RELATED APPLICATION

Reference is hereby made to the following copending U.S. patent application Ser. No. 07/990,204 filed Dec. 14, 1992 entitled "Base For Electrodeless Discharge Lamp" dealing with related subject matter and assigned to the assignee of the present invention.

FIELD AND BACKGROUND OF THE INVENTION

The invention relates to an electrical lamp base and socket assembly for mechanically holding and supplying power to an electrical lamp having a vitreous envelope, the base and socket assembly allowing mainly axial motion for the lamp and avoiding any turning motion over an angle of greater than 90 degrees during its insertion into and removal from the socket. The invention relates also to a method of operating an electrical lamp base and socket assembly.

The present electrical lamp base and socket assembly can be utilized favorably with several kinds of electrical lamps, i.e. incandescent lamps, discharge lamps, and especially also with electrodeless high intensity discharge lamps.

In the case of typical lamp bases and sockets, generally, a turning motion is employed during the insertion of the lamp into or the removal of it from the socket. In some cases, e.g. in the case of an electrodeless high intensity discharge lamp with an outer induction coil, the performance of such turning motion is relatively difficult because the outer envelope of the lamp has to be surrounded by a close-fitting induction coil which limits the area of the envelope which can be gripped during the turning of the lamp. Thus, there is sometimes a definite demand for lamp bases and socket assemblies which can be used by moving the lamp in the direction of its axis and avoiding any turning motion or at least over a certain maximum value of the turning angle.

Additionally, because of the outer surrounding coil, for an electrodeless HID lamp, there is a further requirement that the base and socket assembly have a smaller outer diameter than the lamp envelope so as to allow movement through the outer coil. For an example of this dimensional relation between the outer envelope and the induction coil of an electrodeless HID lamp, reference is made to U.S. Pat. No. 5,150,015 issued to Heindl et al. on Sep. 22, 1992.

Electrical lamp base and socket assemblies of the kind mentioned in the introductory paragraph and for application with incandescent lamps are well-known as the bayonet lamp base and lamp holder. In the case of bayonet lamp bases and lamp holders, the base is usually made of metal and has two protruding pins on its lamp base for engaging two L-shaped slots in the lamp holder, providing in such a way the mechanical holding and power supply of the incandescent lamp. These protruding pins however increase the outer size of the lamp base and would thus be inappropriate for an application involving an outer envelope which must fit within an induction coil.

In fields different from that of electric lamps, there are several known kinds of latch mechanisms for mechanically holding one or another component part, (e.g. in the case of the locking mechanism of cabinet doors).

The component part, a locking dowel, is fixed on the door and has to be inserted into and removed from a latch mechanism by axial motion. Mechanical holding of this kind is mentioned in the U.S. Pat. No. 2,637,576.

OBJECT AND SUMMARY OF THE INVENTION

The object of the present invention is to provide an electrical lamp base and socket assembly for mechanically holding and supplying power to an electrical lamp having a vitreous envelope, this assembly allowing mainly axial motion for the lamp and avoiding any turning motion over an angle of greater than 90 degrees during its insertion into and removal from the socket, and where the size of the lamp base is minimized.

The invention is based on the recognition that the object mentioned can be achieved if a slot or slots on the lamp base and protruding mechanical means in the socket are appropriately formed, which mechanical means engage the slot and hold the lamp by means of spring force.

In order to solve the object, the invention provides an electrical lamp base and socket assembly for mechanically holding and supplying power to an electrical lamp having a vitreous envelope, the assembly allowing mainly axial motion for the lamp and avoiding any turning motion over an angle greater of 90 degrees during its insertion into and removal from the socket, and wherein the lamp base is made of an electrically and thermally insulating material which surrounds the neck portion of the vitreous envelope and is fixed onto it. Furthermore the lamp base has at least one slot on its outer surface which is formed without causing any increase in size of the lamp base and further wherein the lamp base has at least one bore formed in its inside and through which at least one electrically conductive means extends from the lamp base contact towards the lamp. Furthermore, the socket is made of an electrically and thermally insulating material and has a hole for the lamp base. Additionally, the socket has mechanical means with a spring mechanism and protruding parts engaging the slot of the lamp base at insertion and which is effective for holding the lamp in the socket and releasing it at removal of the lamp. Furthermore, the socket has at least one electrical connecting means coupled through the socket for providing electrical connection from the power source to the lamp base contact.

The present electrical lamp base and socket assembly can have more than one slot and mechanical means and more than one electrically conductive means and electrical connecting means.

The lamp bases usually have a cylindrical shape and the slot is preferably placed on the surface of the cylinder.

The electrical lamp base and socket assembly can be formed according to the invention so that the slot(s) on the lamp base is L-shaped like that of a bayonet lamp holder, and the mechanical means in the socket is a protruding pin (or pins) also like that of a bayonet lamp base and a contacting end protruding from the socket and being loaded by the spring mechanism, where the lamp base is held in the socket between the pin (or pins) and the contacting end.

The pin can be made of the insulating material of the socket.

The electrical lamp base and socket assembly according to the invention can be formed also so that the mechanical means of the socket is a latch mechanism, which engages the slot on the lamp base.

The latch mechanism can have as protruding parts, a hook and a tongue, wherein the hook continues in an arm, which is in mechanical connection with a spring mechanism. On the other hand, the spring mechanism is in mechanical connection with the tongue, which touches with the top of the lamp base. The spring force of the spring mechanism provides for the mechanical holding of the lamp between the hook and tongue in the socket.

The tongue can be used not only for the mechanical holding but also for an electrical connection.

In the case of a latch mechanism for example, the lamp base can also have an angular or square form, rather than being axisymmetric. The advantage of the use of the latch mechanism is that no rotational alignment is needed at all.

The first and/or second electrical connection between the power source and the lamp base contact (i.e. the electrical connecting means) can be formed by a separate spring contact and/or by a spring loaded contact as part of the mechanical means.

The construction of the electrical lamp base and socket assembly can be simplified if the mechanical means of the socket provides also for the electrical connection between the power source and the lamp base contact, (i.e. if the electrical connecting means of the socket is the same as the mechanical means). Although, it is to be mentioned that at a lamp operation of very high frequency, a latch mechanism containing more mechanical component parts and being applied also as an electrical connecting means can cause difficulties in the power supply, thus, separate electrical connecting means can be preferable in certain cases.

The invention provides an electrical lamp base and socket assembly which needs only an axial lamp motion during the insertion into and removal from the socket, without causing any increase in the size of the lamp base by any protruding component part on its surface. A lamp base and socket assembly in accordance with the invention can be used with several kinds of lamps. In the case of the electrodeless high intensity discharge lamps with a surrounding induction coil, the invention is of special importance.

In the case of the electrodeless lamps, the "supplying power to the lamp" means the providing of energy effective for initiating a gas discharge within the electrodeless arc tube, furthermore the "electrically conductive means" is a means which couples the energy from the lamp base contact towards the arc tube or more precisely towards the starting aid of the lamp.

BRIEF DESCRIPTION OF THE DRAWING

The invention will be further described in more detail by way of examples and with reference to preferred embodiments with drawing, wherein.

DETAILED DESCRIPTION OF THE INVENTION

Figure 1:
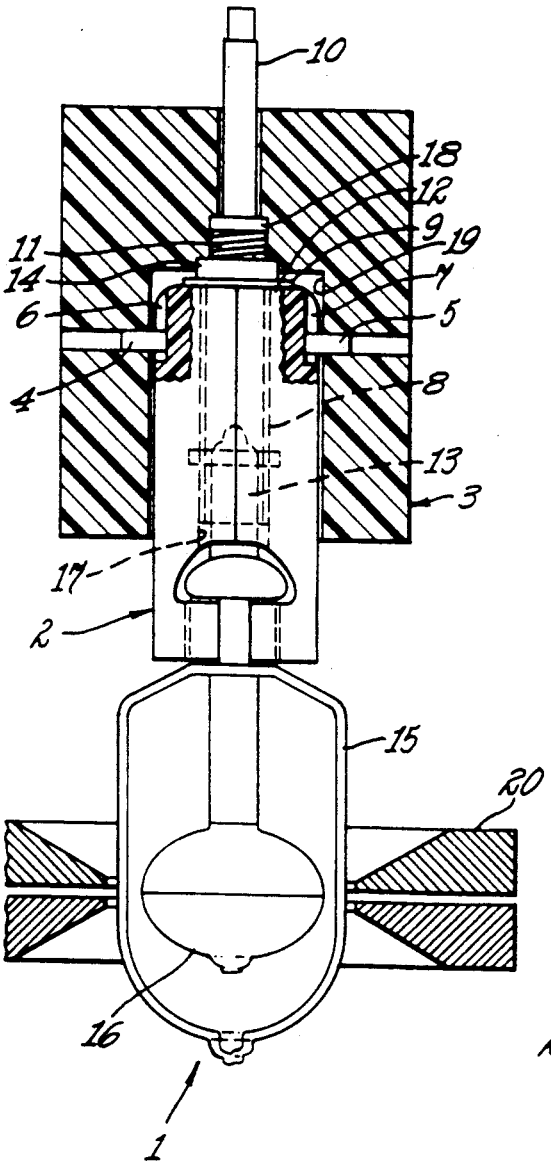
FIG. 1 shows an electrical lamp base and socket assembly for electrodeless high intensity discharge lamp, partly in sectional front view.
Figure 2:
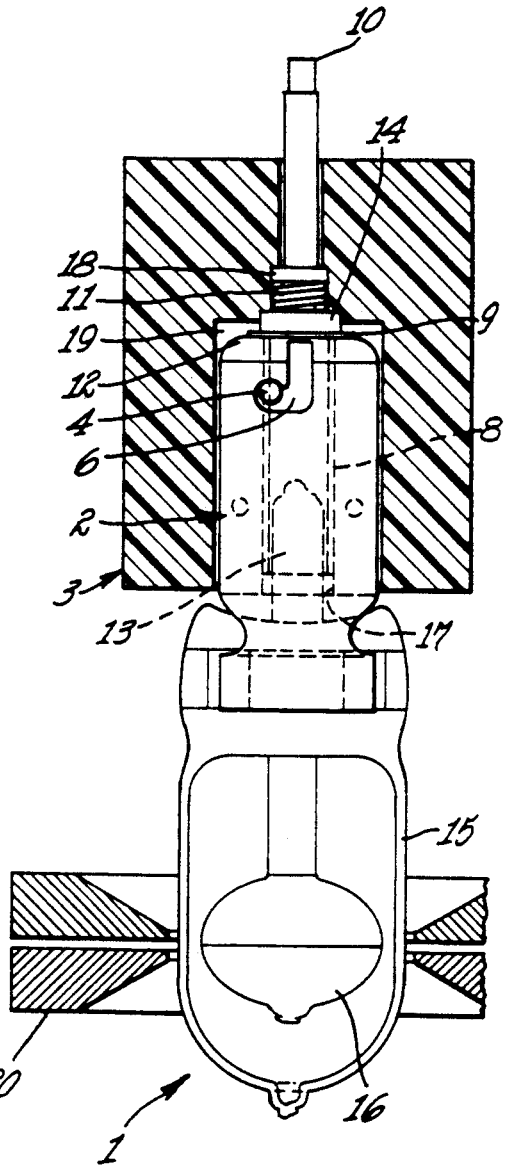
FIG. 2 shows the electrical lamp base and socket assembly according to FIG. 1, partly in sectional side view.

As shown in FIGS. 1 and 2, the lamp 1 is an electrodeless high intensity discharge lamp placed in an induction coil 20 during operation. The lamp 1 has an arc tube 16, a vitreous outer envelope 15, a starting aid 13 and a lamp base 2. The lamp base 2 has a cylindrical shape and is made of two symmetrical parts in order to simplify the mounting; furthermore, the lamp base 2 is mechanically fixed onto the neck portion of the envelope 15. The lamp base 2 is made of an insulating material such as ceramic or plastic, which is capable of withstanding heat arising during the operation of the lamp 1. There are two symmetrical L-shaped slots 6, 7 on the cylindrical surface of the lamp base 2, and a bore 17 in its middle, which contains the electrically conductive means 8. This electrically conductive means 8 is a tube made of brass for example, which has a flat circular end portion that constitutes the lamp base contact 9 at the top 12 of the lamp base 2. The starting aid 13 which is in connection with the arc tube 16 extends into the electrically conductive means 8 within the bore 17.

The socket 3 is also made of an insulating material such as ceramic or plastic, which has to stand the heat arising during the operation, which may be less than that at the lamp base 2. The socket 3 has a hole 19 for the lamp base 2 and two symmetrical protruding pins 4, 5 made preferably of the material of the socket 3. The lamp base 2 of the inserted lamp 1 is mechanically held between the pins 4, 5 and a protruding contacting end 14 with a spring mechanism constituted by the spring 1 1. An electrical connecting means 1 0 at the socket 3 is a rod made of conductive material such as brass and ends in the spring loaded contacting end 14 mentioned, which also provides the power supply to the lamp base contact 9. The spring 1 1 placed in a seating 18 behind the contacting end 14 provides also for a solid electrical contact between the contacting end 14 of the electrical connecting means 10 and the lamp base contact 9. The other end of the electrical connecting means 10 (which is not shown) is connected to the power source which is an excitation circuitry (not shown) placed preferably in the lighting fixture (not shown).

The insertion of the lamp 1 into the socket 3 can be accomplished by an almost only axial lamp motion so that the portions of the slots 6, 7 which extend parallel with the axis of the lamp 1 have to be engaged with the pins 4, 5 of the socket 3, and the lamp 1 has to be pushed in axial direction against the spring loaded contacting end 14 until the pins 4, 5 reach the inflection point of the slots 6, 7. From here, the lamp 1 has to be turned some degree until the pins 4, 5 reach the end of the slots 6, 7, which bend back slightly in order to constitute a seat to the pins 4, 5.

The FIGS. 3, 4, 5, 6 and 7 show another example on the invention. The electrodeless high intensity discharge lamp 21 has an arc tube 36, a vitreous outer envelope 35, a starting aid 33 and a lamp base 22. The lamp base 22 has a cylindrical shape and is mechanically fixed onto the neck portion of the envelope 35. The lamp base 22 has a slot 29 cut circumferentially into the cylinder surface and furthermore has a bore 37 in its middle. A tube constituting the electrically conductive means 30 is disposed within the bore 37 and has a flat circular end portion constituting the lamp base contact 31 at the top 32 of the lamp base 22.

The lamp is placed in the socket 23 after being passed through the induction coil 40. The socket 23 has a hole 34 for the lamp base 22 and a housing 28 with a latch mechanism 24 which constitutes both the mechanical means and the electrical connecting means, and which contains as protruding parts, a hook 25 and a tongue 26. The hook 25 has an arm which is mechanically connected to a spring mechanism 27. The spring mechanism 27 is also mechanically connected to the tongue 26. The spring mechanism 27 contains preferably two springs in order to accord the movement of the hook 25 and the tongue 26. The wider portion of the hook 25 can rotate about one of the two pivots 38, 39, which are fixed in the housing 28.

Figure 3:
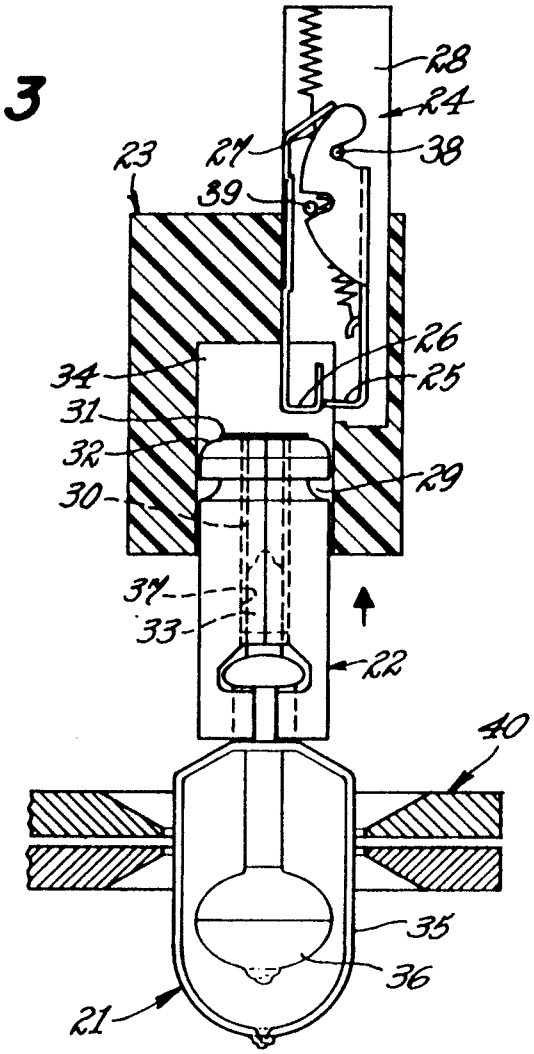
FIG. 3 shows another electrical lamp base arid socket assembly for electrodeless high intensity discharge lamp during insertion of the lamp, partly in sectional front view.

The FIG. 3 shows the lamp 21, and the lamp base 22 and socket 23 assembly at the first insertion step, when the latch mechanism 24 is still in its neutral basic position. The lamp 21 can be gripped by its envelope 35 and the lamp base 22 is partly inserted into the hole 34 of the socket 23.

Figure 4:
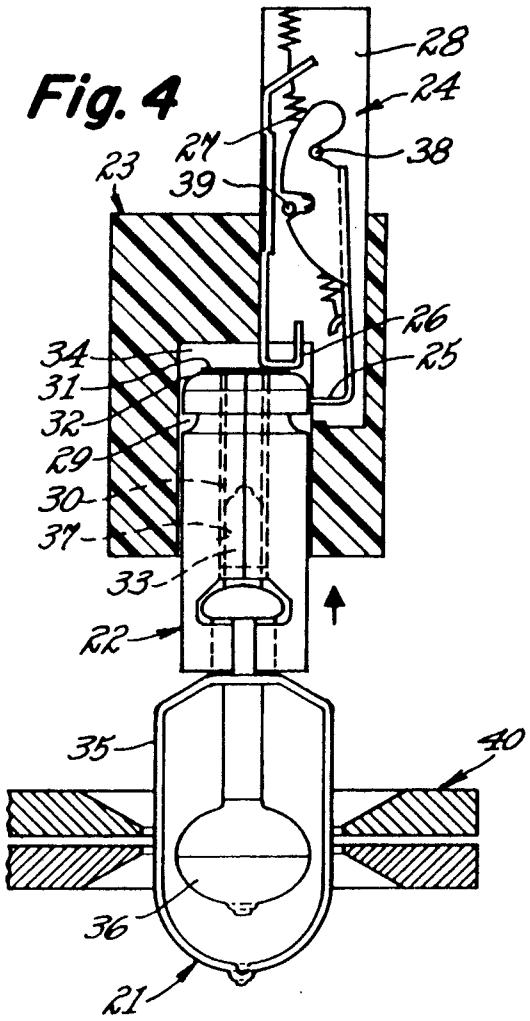
FIG. 4 shows the electrical lamp base and socket assembly according to FIG. 3 in a next insertion step, partly in sectional front view.

The FIG. 4 shows the lamp 21, and the lamp base 22 and socket 23 assembly after a certain axial pushing of the lamp 21, when the hook 25 and the tongue 26 of the latch mechanism 24 have been pushed away and pressed into the housing 28 by means of the top 32 of the lamp base 22, extending into the hole 34. In this position the hook 25 can rotate about the pivot 38.

Figure 5:
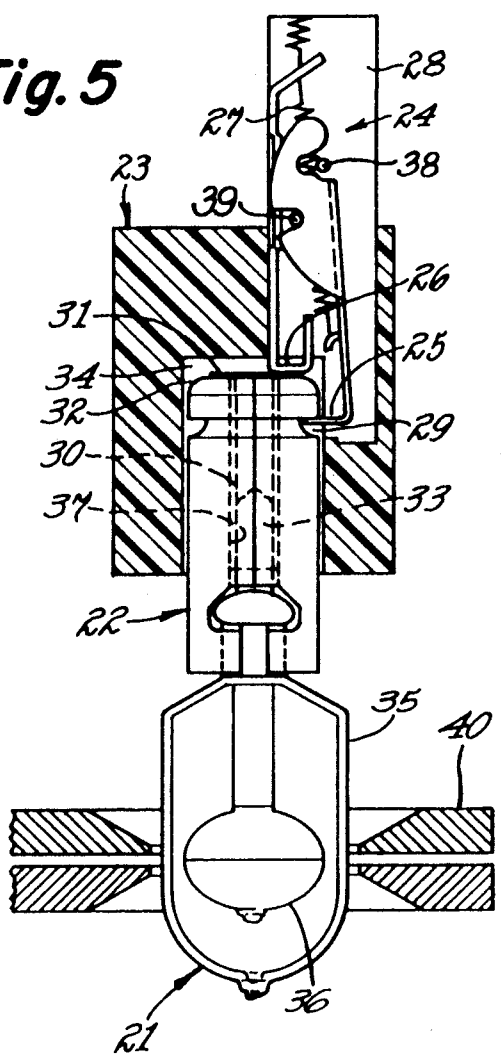
FIG. 5 shows the electrical lamp base and socket assembly according to FIGS. 3 and 4 during holding of the lamp, partly in sectional front view.

The FIG. 5 shows the lamp 21 after insertion, when the latch mechanism 24 has fully engaged the slot 29 of the lamp base 22. The tongue 26 is in a pressed position against the spring force of the spring mechanism 27, and the hook 25 is snapped into the slot 29 by means of the spring force of the spring mechanism 27 as well.

Also the power supply to the lamp 21 is provided through the latch mechanism 24, by means of the tongue 26, which is made of brass (or other metal or alloy or plated metal) and which contacts the lamp base contact 31.

Figure 6:
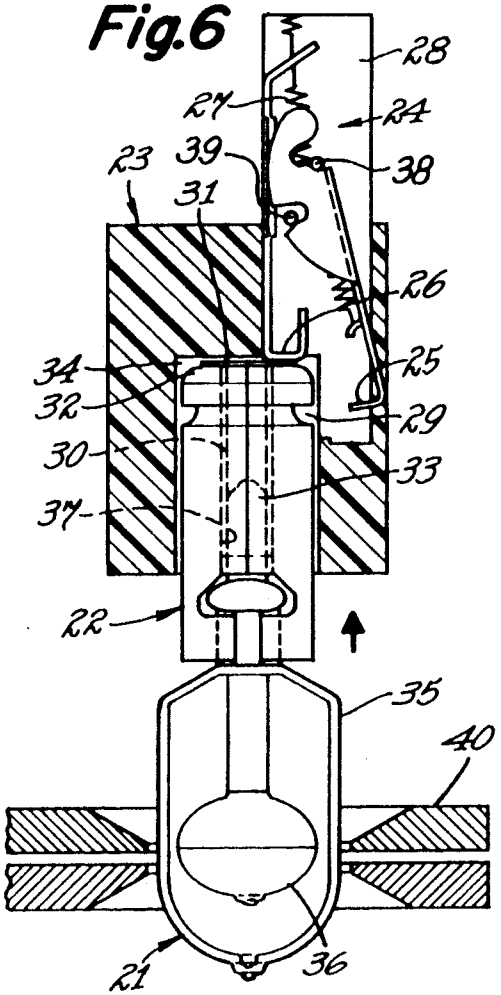
FIG. 6 shows the electrical lamp base and socket assembly according to FIGS. 3, 4 and 5 during removal of the lamp, partly in sectional front view.

The FIG. 6 shows the lamp 21 during removal from the socket 23, at the beginning of the removal. The lamp 21, gripped by its envelope 35, is pushed further into the hole 34, whereby the tongue 26 is pressed further into the housing 28, while the hook 25, moved by means of the spring mechanism 27, can release the slot 29. In this position the hook 25 can rotate about the pivot 39, and the spring mechanism 27, which is pressed from its one side by the tongue 26, on its other side pulls and holds the hook 25 in its lifted position while the tongue 26 is pushed into the housing 28.

Figure 7:
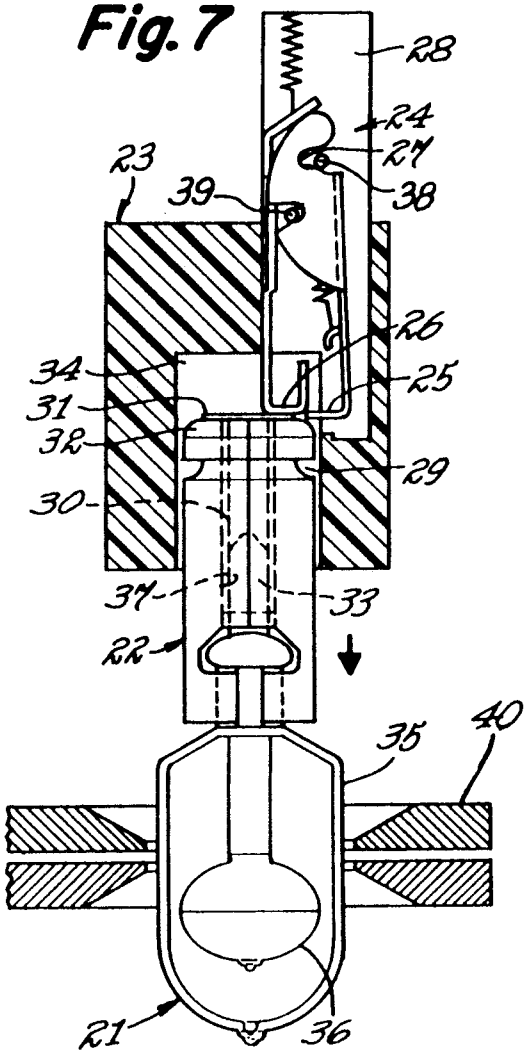
FIG. 7 shows the electrical lamp base and socket assembly according to the FIGS. 3, 4, 5 and 6 in a next removing step, partly in sectional front view.

The FIG. 7 shows the lamp 21 in a next removal step, when the lamp base 22 has already been removed away from the latch mechanism 24, and the lamp 21 can be pulled freely out of the socket 23. While the tongue 26 is being pressed onto the top 32 of the lamp base 22 by the spring force of the spring mechanism 27, the lamp base 22 follows for some way until the latch mechanism 24 can again reach its neutral basic position. This occurs because the upper portion of the tongue 26 pushes the hook 25 at its wider portion about the pivot 38, while the hook 25 comes back into its basic position.

Figure 8:
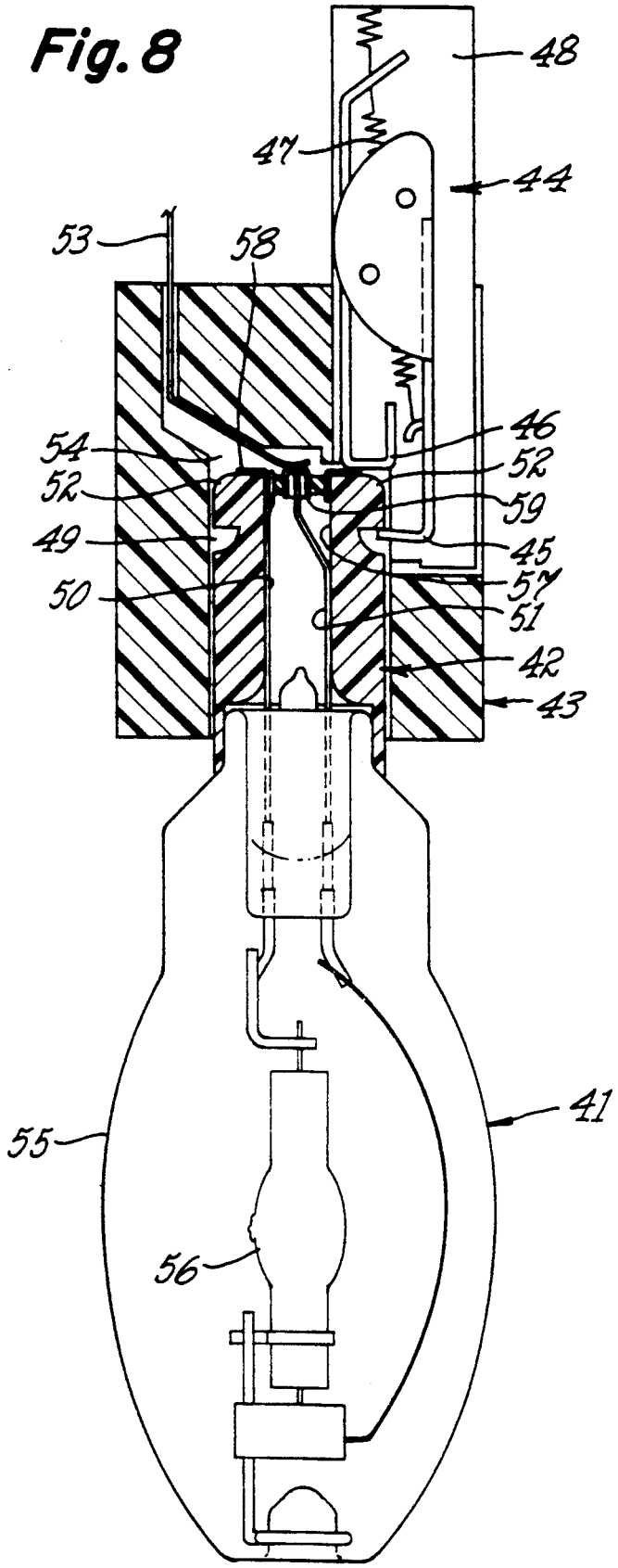
FIG. 8 shows an electrical lamp base and socket assembly for a discharge lamp with two electrodes, partly in sectional front view.

In FIG. 8, a metal halide lamp 41 is shown having a traditional arc tube 56 with two electrodes and placed in a vitreous outer envelope 55, having furthermore a lamp base 42 of insulating material with a bore 57, through which the electrically conductive means 50 and 51 are coupled from the lamp base contacts 58 and 59 to the electrodes in the inside of the lamp 41. The lamp base contacts 58 and 59 are electrically insulated from each other. The lamp base 42 is mechanically fixed onto the neck portion of the envelope 55, and has a slot 49 on its surface cut circumferentially into it.

The socket 43, made of insulating material, has a hole 54 for the lamp base 42 and a housing 48 for the latch mechanism 44, which contains the hook 45, the spring mechanism 47 and the tongue 46. The mechanical operation of the latch mechanism 44 is similar to that of the latch mechanism 24 in FIGS. 3, 4, 5, 6 and 7. One electrical connection to the lamp 41 is provided by the tongue 46 of the latch mechanism 44. The tongue 46 contacts the annular lamp base contact 58, which is connected with the electrically conductive means 50. The second electrical connection to the lamp 41 is provided by a spring contact 53, which is led through the socket 43 and connects the power source to the lamp base contact 59, which is connected with the electrically conductive means 51.

The lamp base contacts 58 and 59 are formed on the top 52 of the lamp base 42, but can be placed on the side surface of the lamp base 42, as well.

While the preferred embodiments of the present invention have been shown and described herein, thus, such embodiments are provided by way of example only. Numerous variations, changes and substitutions can be made without departing from this invention. Accordingly, it is to be emphasized that only the appending claims limit the invention.

What we claim as new and desire to secure by Letters Patent of the United States is:

1. Electrical lamp base and socket assembly for mechanically holding and supplying power to an electrical lamp having a vitreous envelope, said lamp base and socket assembly allowing mainly axial motion for the lamp and avoiding requirement of any turning motion over an angle of greater than 90 degrees during insertion of the lamp into and removal from the socket, said lamp base and socket assembly comprising:

a lamp base member made of insulating material surrounding a neck portion of the vitreous envelope and being fixed thereto;

said lamp base having at least one slot on its outer surface, without causing any increase in size of said lamp base and wherein said lamp base has a cylindrical shape and said slot is placed on a cylindrical surface of said lamp base;

at least one bore formed in said lamp base and through which at least one electrically conductive means extends from a lamp base contact towards the lamp;

a socket made of insulating material, and having a hole formed therein for said lamp base, said socket having disposed therein, mechanical means including a spring mechanism and protruding parts for engaging said slot of said lamp base at insertion and for holding the lamp in said socket and releasing it at lamp removal; and electrical connecting means in said socket for providing electrical connection from a power source to the lamp base contact.

2. Electrical lamp base and socket assembly as in claim 1, wherein at least one of said electrical connecting means of said socket is the same as at least one of said mechanical means.

3. Electrical lamp base and socket assembly as in claim 1, wherein said slot on said lamp base is L-shaped, and said mechanical means in said socket includes a protruding pin and a contacting end protruding from said socket and being loaded by said spring mechanism, wherein said lamp base is held in said socket between said pin and said contacting end.

4. Electrical lamp base and socket assembly as in claim 3, wherein said contacting end being loaded by said spring mechanism provides for the electrical connection between the power source and said lamp base contact.

5. Electrical lamp base and socket assembly as in claim 3, wherein said pin is made of the insulating material of said socket.

6. Electrical lamp base and socket assembly as in claim 1, wherein said mechanical means disposed in said socket is a latch mechanism, and said slot is shaped in such a manner that said latch mechanism can engage it.

7. Electrical lamp base and socket assembly as in claim 6, wherein said protruding parts of said latch mechanism include a hook and a tongue, and said hook continues in an arm, which is in mechanical connection with said spring mechanism, and on the other hand said spring mechanism is in mechanical connection with said tongue, which touches at least with a portion of the top of said lamp base, and spring force of said spring mechanism provides for the mechanical holding of said lamp between said hook and said tongue in said socket.

8. Electrical lamp base and socket assembly as in claim 7, wherein said tongue provides for an electrical connection from the power source to the lamp base contact.

9. Electrical lamp base and socket assembly as in claim 1, wherein a spring contact extending through said socket provides for the electrical connection from the power source to the lamp base contact.

* * * * *